United States Patent [19]

Ferguson et al.

[11] Patent Number: 4,856,491

[45] Date of Patent: Aug. 15, 1989

[54] HIGH EFFICIENCY SOLID FUEL BURNING STOVE

[75] Inventors: Robert W. Ferguson, South Royalton; Derik K. Andors, Randolph, both of Vt.

[73] Assignee: Vermont Castings, Inc., Randolph, Vt.

[21] Appl. No.: 173,236

[22] Filed: Mar. 25, 1988

[51] Int. Cl.[4] ..... F24C 1/14

[52] U.S. Cl. ..... 126/77; 126/76; 126/83; 126/193

[58] Field of Search ..... 126/15 R, 58, 65, 66, 126/67, 68, 70, 73, 76, 77, 242, 245, 193, 198, 200, 83

[56] References Cited

U.S. PATENT DOCUMENTS

| | | | |
|---|---|---|---|
| 644,792 | 3/1900 | Boal | 126/76 |
| 2,481,164 | 9/1949 | Sherman et al. | 126/73 |
| 2,497,877 | 2/1950 | Fellows | 126/73 |
| 2,967,522 | 1/1961 | Takahashi | 126/73 |
| 3,259,083 | 7/1966 | Evans | 110/8 |
| 4,221,207 | 9/1980 | Syme | 126/77 |
| 4,249,509 | 2/1981 | Syme | 126/77 |
| 4,279,238 | 7/1981 | Syme | 126/77 |
| 4,367,725 | 1/1983 | Syme | 126/77 |
| 4,425,305 | 1/1984 | Retallick | 422/180 |
| 4,487,195 | 12/1984 | Syme et al. | 126/77 |
| 4,499,889 | 2/1985 | Syme | 126/75 |
| 4,510,918 | 4/1985 | Ferguson et al. | 126/79 |
| 4,646,712 | 3/1987 | Ferguson et al. | 126/77 |
| 4,658,801 | 4/1987 | Black | 126/77 |
| 4,683,868 | 8/1987 | Ferguson et al. | 126/193 |

FOREIGN PATENT DOCUMENTS

| | | | |
|---|---|---|---|
| 0040100 | 11/1981 | European Pat. Off. . | |
| 778207 | 3/1935 | France | 126/76 |
| 490194 | 8/1938 | United Kingdom . | |

OTHER PUBLICATIONS

The Development of a Design of Smokeless Stove for Bituminous Coal, B. A. Landry and R. A. Sherman--Jan. 1950, Columbus, Ohio.

The Efficiency of Bituminous-Coal-Burning Space Heaters, John W. Tieman and Frederick L. Bagby, Columbus, Ohio-Jan. 1951.

Cross-Fed Combustion for Clean Burning of Solid Fuels for Residences, Richard B. Engdahl, Houston, Texas-Jun. 1978.

*Primary Examiner*—Noah P. Kamen

*Attorney, Agent, or Firm*—Wolf, Greenfield & Sacks

[57] ABSTRACT

A solid fuel heating apparatus including a secondary combustion chamber in gaseous communication with a primary combustion chamber for increasing heating efficiency and for reducing polluting emissions. The secondary combustion chamber is lined with a refractory material. The entrance to the secondary combustion chamber is disposed at the bottom thereof adjacent the grate, and the grate containing the fuel is sloped at an acute angle with respect to the vertical to cause charcoal to accumulate adjacent to the orifice and to cover the entrance orifice of the secondary combustion chamber. Exhaust gases drawn into the secondary combustion chamber must first pass through the charcoal so that they are preheated prior to being mixed with secondary air. Means are provided for metering secondary air into the entrance orifice to cause mixing of the secondary air with the exhaust gases when the exhaust gases are at their maximum temperature. Refractory baffles are disposed within the secondary combustion chamber to enhance mixing of the combustion gases and to reradiate heat into the combustion gases. The baffles are vertically aligned at the bottom to reduce flow restrictions but still cause significant mixing, and are curved at the top to focus the gases into a choke zone. The side walls of the stove are insulated to contain heat within the primary combustion chamber.

21 Claims, 5 Drawing Sheets

HIGH EFFICIENCY SOLID FUEL BURNING STOVE

1. FIELD OF THE INVENTION

This invention relates generally to solid fuel stoves, and more particularly to wood burning stoves provided with secondary combustion means for reducing the levels of polluting emissions while maintaining a high level of heating efficiency.

2. BACKGROUND OF THE INVENTION

In recent years, wood and coal burning stoves have gained widespread popularity for home heating. These stoves operate efficiently and for long periods of time in a slow combustion mode. The joints of such stoves are tightly sealed and air flow into the stove is carefully controlled. Such slow burning stoves operate very efficiently, but are subject to soot and creosote build-up in the stove itself, as well as in the chimney or stovepipe. In addition, as wood is burned, products of both complete and incomplete combustion are created which contain polluting emissions, including particulate material and unburned volatiles, and which are discharged into the atmosphere. This problem is exacerbated when burning at low heat levels in an oxygen-starved mode. Creosote build-up is dangerous because it can ignite, causing a hazardous chimney fire. The particulate emissions and the unburned volatiles are damaging to the environment. Furthermore, the heating value of the unburned volatiles is wasted, as they are discharged into the atmosphere.

Various techniques are presently used to remove the creosote and particulate emissions, as well as to burn the volatiles, to provide a cleaner burning stove having a high thermal efficiency. One known apparatus is a catalytic combustor or converter, such as that disclosed in U.S. Pat. No. 4,646,712, assigned to the assignee of the present application. Such known catalytic combustors usually include a thick, perforate honeycomb structure of ceramic or other material coated with a catalyst material such as platinum, paladium, or rhodium. The surface properties of these catalyst materials are such that the combustion products, too cool to burn unaided, will burn within the catalytic combustor.

Many manufacturers have introduced retrofit units for existing stoves which include catalytic combustors for reducing the levels of smoke and creosote and for increasing efficiency. The operation of many of such known retrofit units is unpredictable at best, and depends substantially upon the base appliance to which it is attached. A marginal situation in many prior art retrofit units is caused by locating the retrofit catalytic combustor too far from the wood stove fire box. This location causes the exhaust gases entering the catalyst to have a temperature which is too low for optimum catalyst performance, particularly when the stove is operated at lower heat output levels. A retrofit unit which overcomes many of the problems associated with other prior art retrofit units is described in U.S. Pat. No. 4,646,712, assigned to the assignee of the present application.

Wood burning stoves are also known which employ a secondary combustion system without a catalytic combustor for further burning of gases from the primary combustion chamber. In many such non-catalytic combustor designs, multiple primary and secondary air introduction systems are used. Frequently, horizontal baffles are employed which project across the top of the fire box, dividing the fire box into primary and secondary combustion zones. The lower half of the fire box is generally surrounded with refractory fire brick or insulation. Such prior art designs are dependent upon heat produced and contained in the fire box to promote the secondary combustion of remaining unburned pollutants above the baffle, and they work best primarily at higher fuel combustion rates.

Generally, such wood burning stoves with secondary combustion systems, even if they are capable of sustaining combustion prior to a log shift, may "wink out" during a change in the exhaust gas composition due to a shift in the fuel load, caused, for example, by a falling log. Even if the exhaust gas composition is restored shortly after the disturbing event, the secondary system may not reignite if it has cooled down sufficiently in the meantime. The reason for this "wink out" phenomenon is that to maintain secondary combustion in a clean burn mode in a stove with a conventional secondary combustion system, the combination of sensible heat (the heat contained within the gases before they enter the secondary system) and latent heat (the heat released when the combustible constituents of the gases are burned in a secondary system) present in the gas mixture must be sufficiently high to continuously maintain temperatures in the secondary system of about 1000–1200° F. If the gas mixture changes temporarily so that the total amount of heat (sensible and latent) available to the secondary system is insufficient to maintain the proper temperature, secondary combustion will cease. The gases will not reignite, no matter how rich, until they are again brought up to a temperature of 1000–1200° F. when entering the secondary system. In general, reignition requires attention from the operator similar to that required during the initial lighting of the secondary system. Operation of a stove with a secondary combustion system when the secondary combustion is extinguished is to be avoided, since the resulting creosote and other emissions typically will equal those in a conventional wood stove having no secondary system.

Another problem found in association with conventional secondary combustion systems is that they do not function at low burn rates in which the heat output from the primary combustion chamber is lower. It is these low burn rates which are generally employed by the public in wood burning stoves and which are the primary focus of most governmental regulations. During such low burn rate operations in many prior art systems, the gases exiting the primary combustion chamber are often at too low a temperature to sustain ignition in the secondary combustion system.

It is therefore a general object of this invention to provide a clean burning solid fuel heating apparatus having a high thermal efficiency.

It is another object of the present invention to provide an efficient solid fuel heating stove having an integral secondary combustion package for removal of creosote, particulate emissions, and unburned volatiles prior to release of the exhaust gases to the atmosphere.

It is a further object of the present invention to provide a wood burning stove which meets or exceeds all government regulations relating to emission levels for gaseous and particulate constituents, and which has a high level of thermal efficiency.

It is yet a further object of the present invention to provide an efficient wood burning stove having a non-catalytic design for removal of particulate material, unburned volatiles, and creosote and which is capable of sustaining its performance over a range from very low burn rates to very high burn rates.

It is yet another further object of the present invention to provide an efficient wood burning stove having non-catalytic design for removal of particulate material, unburned volatiles, and creosote which will continue to remove such gaseous and particulate materials, regardless of momentary changes in the exhaust gas constituents.

SUMMARY OF THE INVENTION

According to the present invention, these and other objects and advantages are achieved in a heating apparatus for burning solid fuels comprising a primary combustion chamber, and an internal, secondary combustion package in which a constant but specific amount of secondary combustion air is mixed with and aids in the combustion of unburned pollutants. The secondary combustion package does not utilize a catalytic combustor, but rather relies upon heat generated in the primary combustion chamber, in combination with heat produced by secondary combustion within the secondary combustion package, to sustain the secondary combustion for removal of the unburned pollutants.

In one aspect of the invention, the entrance orifice to the secondary combustion package is disposed at a low point on the fireback in the primary combustion chamber, which is a natural collection area for the charcoal formed during the combustion process. A sloping bottom grate is provided to enhance the accumulation of charcoal against the rear of the fireback. The combination of the sloping grate, which slopes downwardly toward the entrance orifice, and the location of the orifice, causes the entrance orifice to be covered by charcoal formed by the combustion process under normal operating conditions. As a consequence, the exhaust gases are forced to pass through the charcoal prior to their entrance into the secondary combustion package. Unburned oxygen remaining in the exhaust gases reacts with the charcoal bed, raising the temperature of the exhaust gases to a temperature at which they will combust when mixed with secondary air. This feature permits combustion of the unburned pollutants even during operation at low burn rates. The process is self sustaining in any burn rate, so long as an adequate charcoal bed is established during the kindling phase, prior to adding the first main load, and provided that subsequent fuel loads are added while adequate charcoal remains covering the entrance orifice.

In another feature of the invention, the two primary combustion chamber sidewalls are full insulated from top to bottom. The use of this insulation increases the temperature within the combustion chamber which helps create an adequate amount of charcoal to keep the entrance orifice full, and which prevents a lowering of temperatures during low burn rates below acceptable limits for charcoal production. The insulation also maintains the primary combustion temperature at a higher level which reduces the temperature increase required while gases are passing through the charcoal bed. As a consequence, the overall system is less sensitive to small changes in parameters required to maintain and sustain secondary combustion.

In a further aspect of the invention, the secondary combustion package contains a plurality of generally vertical baffles having curved upper portions which are arranged and configured to reduce flow restrictions while promoting significant mixing of secondary air with the unburned pollutants. The secondary package is formed of a high temperature, low density refractory material which has a highly insulative quality for maintaining the elevated secondary combustion temperatures that are required. The secondary package also provides surfaces which reradiate heat generated during the secondary combustion process to help sustain elevated secondary combustion temperatures. A choke zone formed above the baffles forces the mixture of secondary air and pollutants through a single orifice, again promoting mixing between the unburned pollutants and secondary air and also concentrating the heat. The gases exiting from the secondary combustion package are directed through a channel which causes them to abruptly change direction, again promoting mixing.

In another, further aspect of the invention, means are provided for metering the secondary air into the secondary combustion package at its entrance orifice. In a preferred embodiment, a plurality of uniform diameter ports is evenly distributed across the orifice width. Air passes through an entrance hole in the outer skin of the stove, and into a plenum chamber which distributes the air evenly among the ports. This arrangement causes jets of gas which extend into the entrance orifice, permitting maximum mixing of the secondary air with the exhaust gases at the point where those gases are at their maximum temperature.

In another aspect of the invention, means are provided in association with the entrance hole into the plenum chamber for regulating the amount of secondary air introduced, depending on whether hard wood or soft wood is being burned.

The primary air introduction system includes a primary air inlet on the bottom of the stove, a bottom manifold, and two side manifolds disposed on opposite sides of the stove for conducting the air to a top manifold disposed along the top of the stove. Air is directed from the top manifold downwardly and uniformly over the interior surface of a transparent glass panel disposed on the front door of the stove.

A bypass damper is provided for bypassing the secondary combustion package to facilitate start-up until the requisite amount of charcoal has been formed.

The foregoing invention permits the removal of creosote, particulate material and unburned volatiles from the exhaust gases of a solid fuel stove which burns wood or coal or other solid fuels, while maintaining a high level of thermal efficiency, without using a catalytic combustor. This invention meets all present U.S. Government regulations relating to emission standards for wood burning stoves. This invention also permits the maintenance of secondary combustion during and after composition and temperature changes in the exhaust gases is from the primary combustion chamber, due to shifts in the solid fuel load. Also, the foregoing invention permits the efficient removal of creosote, particulates and unburned volatiles from the exhaust gases over the entire range of burn rates, including even very low burn rates.

DESCRIPTION OF THE DRAWINGS

The objects, advantages and features of this invention will be more clearly appreciated from the following detailed description when taken in conjunction with the accompanying drawings, in which.

DETAILED DESCRIPTION OF THE PREFERRED EMBODIMENTS

Figure 1:
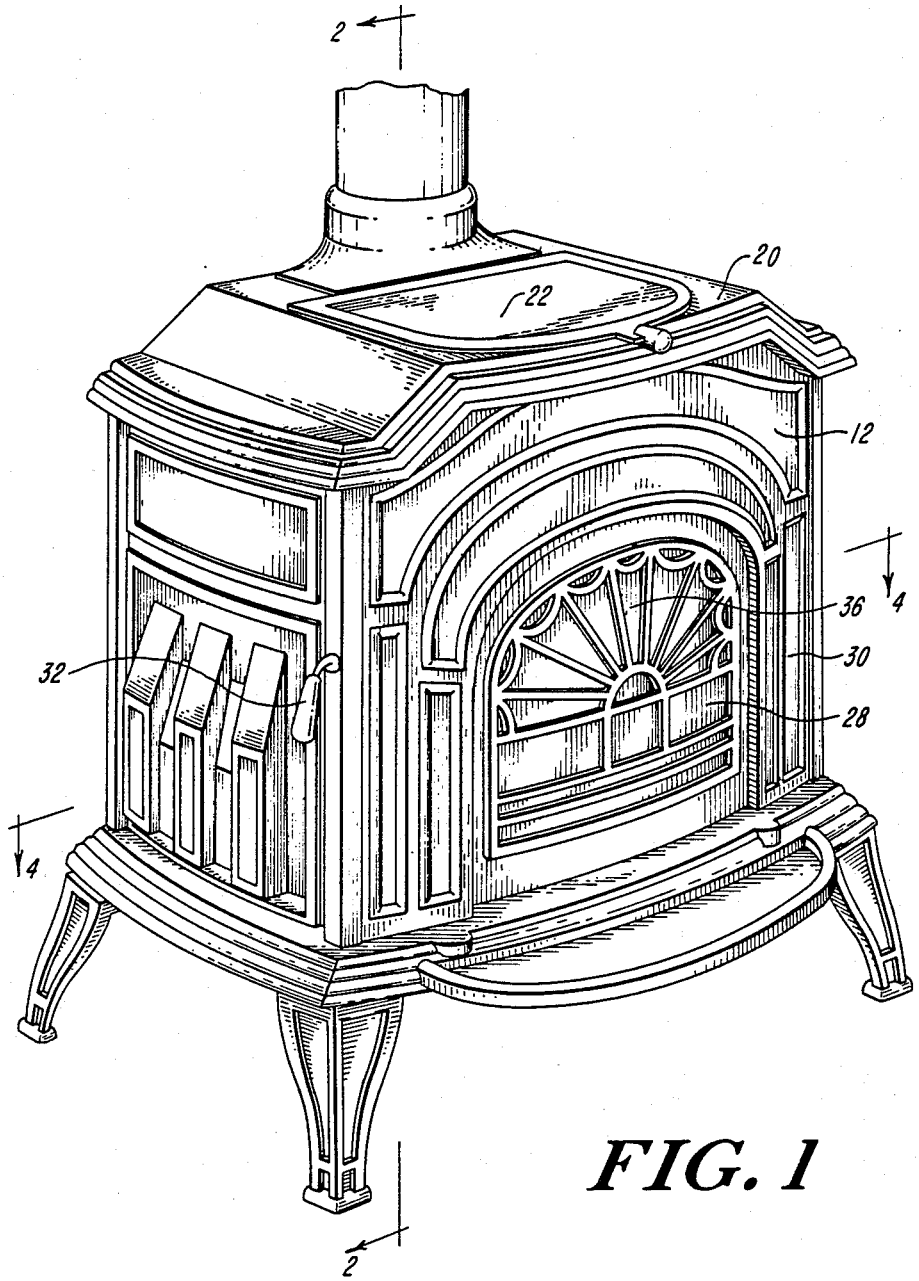
FIG. 1 is a perspective view of a solid fuel stove in accordance with the present invention.
Figure 2:
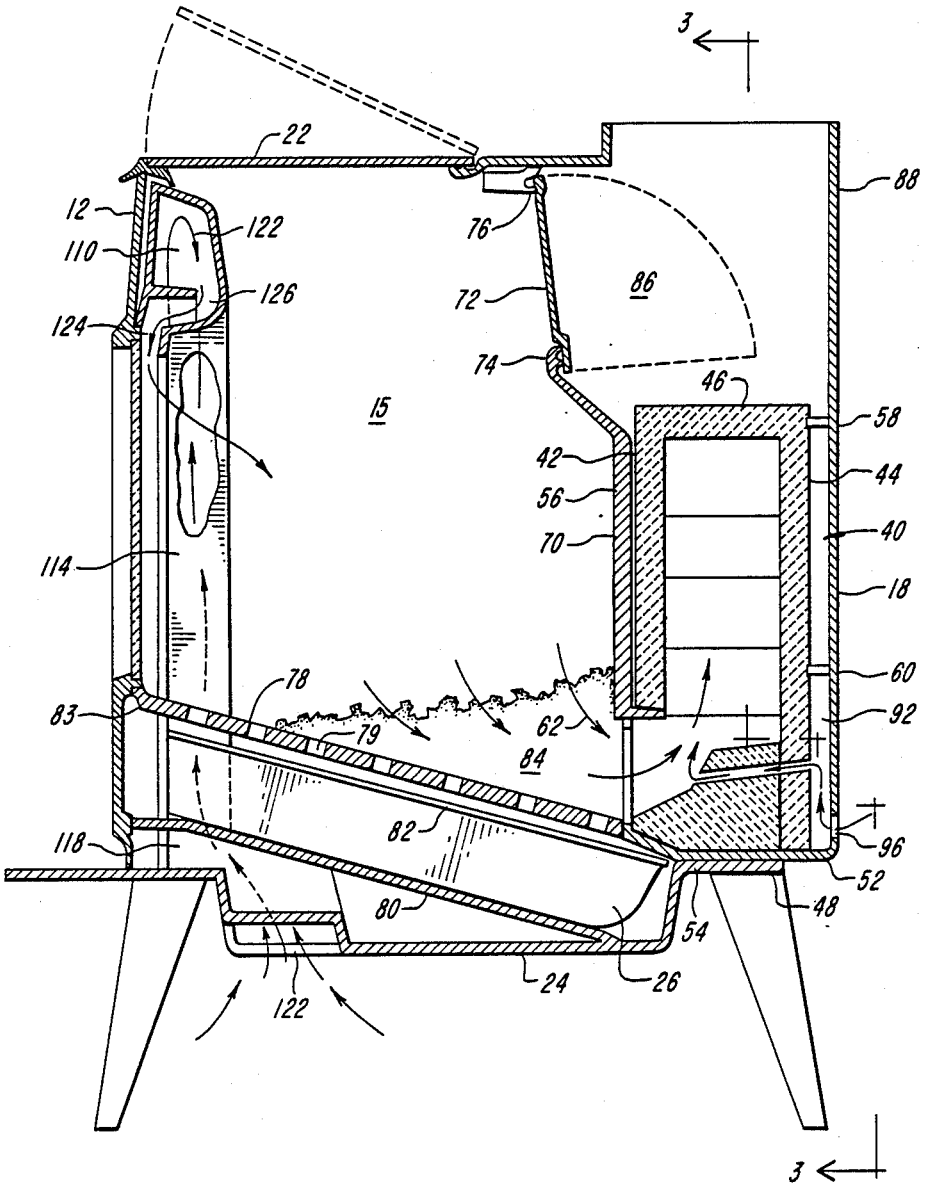
FIG. 2 is a cross sectional side view of the solid fuel stove of FIG. 1 taken along the line 2—2 of FIG. 1.
Figure 3:
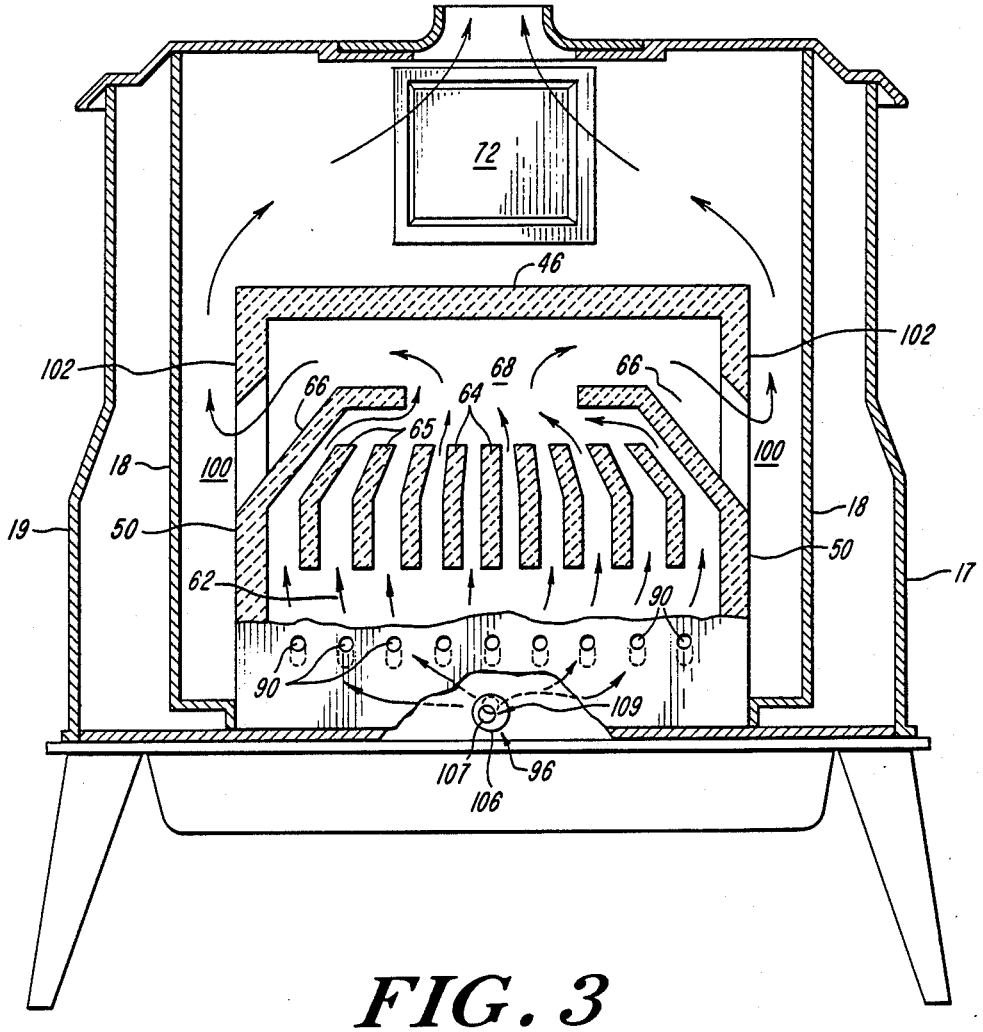
FIG. 3 is a partial cross sectional rear view of the solid fuel stove of FIG. 1 taken along the line 3—3 of FIG. 2.

With reference now to the drawings, and more particularly to FIGS. 1 and 2 thereof, the solid fuel burning stove of this invention will be described. Stove 10 includes a generally vertical front wall 12, inner side walls 14 and 16, outer side walls 17 and 19, a rear wall 18, a top 20, and a bottom 24. Bottom 24 of the stove supports an ash pan 26 for receiving and storing ashes. Walls 12, 14, 16 and 18, top 20 and bottom 24 define a primary combustion chamber 15 where fuel is burned. Outer side walls 17 and 19 are configured to provide a decorative exterior appearance desired for stove 10. Top 20 includes a removable griddle 22 to allow for top loading of the fuel load into the primary combustion chamber.

Stove 10 is provided with a single door 28 pivotally mounted by hinges 30 to front wall 12. Door 28 preferably pivots outwardly from the stove about an axis passing through hinges 30. A latching handle 32 engages a lip (not shown) on front wall 12 to secure the sealed door 28 in a closed position. Preferably, although not necessarily, door 28 is provided with a transparent glass panel 36 for viewing of the fire in the primary combustion chamber 15, while maintaining the generally air tight condition of the chamber 15. Glass panel 36 typically takes up a relatively large portion of door 28 and is positioned relative to the combustion chamber 15 to permit an aesthetically pleasing view of the fire therein. The number and arrangement of doors and the number of glass panels are not central to the present invention. The glass viewing panels can be mounted in one or several of the walls of the stove if desired. Further, more than one door can be used, and the door or doors can be mounted for opening in any desired manner.

As seen in FIG. 2, a fireback 70 defines the rear wall of primary combustion chamber 15. Fireback 70 is formed of the same material as are walls 12, 14, 16 and 18, which typically is cast iron. Fireback 70 extends the entire width of stove 10 from wall 14 to wall 16. Disposed in the upper portion of fireback 70, and preferably centered therein between walls 16 and 14, is a damper 72. Damper 72 typically is pivotally mounted about hinge 74 to allow the operator to bypass secondary combustion package 40 during start up. Damper 72 is manually operated by a handle (not shown) mounted externally of stove 10. Damper 72 is latched in a closed position during normal operation, so that exhaust gases must pass through secondary combustion package 40. A gasket 76 allows maintenance of an air-tight seal around damper 72 when it is closed. Gasket 76 may be formed of any suitable high temperature material, such as a woven fiberglass.

Disposed generally opposite damper 72, and centered in rear wall 18, is flue opening 86 which communicates with a flue collar 88, which in turn is coupled to an exhaust pipe (not shown) for external venting of the exhaust gases.

In accordance with the present invention, stove 10 is provided with a secondary combustion package 40 for creating secondary combustion of exhaust gases exiting chamber 15 for removal of unburned pollutants, such as creosote, particulate wastes and unburned volatiles. Package 40 is located closely adjacent to and generally centered on rear wall 18 of stove 10, so as to be substantially equally spaced from side walls 14 and 16. Package 40 is disposed between fireback 70 and rear wall 18. Package 40 includes front wall 42, rear wall 44, top wall 46, base 48, and side walls 50. An entrance orifice 62 is disposed in the lowest most portion of wall 42. Base 48 of package 40 rests on a support 52. Typically, support 52 is secured to rear wall 18 and extends inwardly therefrom. Additional support for package 40 is provided by a lip 54 which extends beneath package 40 from an upwardly extending portion of bottom 24. Front wall 42 is disposed closely adjacent the back side of fireback 70. Rib 56 extends laterally along the back side of fireback 70 between fireback 70 and wall 42 from side wall 16 to side wall 14. Rib 56 seals the space between package 40 and fireback 70 to prevent leakage of exhaust gases to opening 86 without passing through package 40. Ribs 58 and 60 extend along back wall 18 between side walls 14 and 16, to maintain a spacing between rear wall 44 of package 40 and rear wall 18. Preferably, ribs 58 and 60 extend into the soft material forming wall 44 to form a relatively air tight seal therewith.

A grate 78 is disposed adjacent the bottom of primary combustion chamber 15, and grate 78 is supported above ash pan 26. Grate 78 contains holes, slots, or other perforations 79 to permit ashes to drop into ash pan 26. Grate 78 supports the solid fuel, such as wood or coal, in the primary combustion chamber 15. Perforations 79 are sufficiently small to prevent the resulting charcoal 84 from prematurely falling through into ash pan 26. Ash pan 26 includes lateral lips 82 on its upper edge, and is supported along its entire width and length by a sloping base plate 80 which rests on bottom 24 at its lower end, and on the threshold of the opening for door 28 at its upper end. Access to ash pan 26 for removal can be gained by opening door 28. Typically, removal of ash pan 26 can be accomplished by the use of an ash pan cover (not shown) having a handle. The ash pan cover is slid over lip 82 on the upper edge of ash pan 26, grasping the ash pan for sliding thereof out of door 28.

As shown in FIG. 2, grate 78, base plate 80 and ash pan 26 all are disposed at an acute angle with respect to bottom 24 and generally vertical front wall 42 of package 40. Grate 78 is at its lowest point with respect to bottom 24 adjacent orifice 62 of secondary combustion package 40 and preferably is at its highest point 83 with respect to bottom 24 adjacent door 28. This sloped alignment of grate 78 with respect to bottom 24 and wall 42 causes charcoal 84, formed by the combustion of the fuel, to accumulate adjacent wall 42 of secondary combustion package 40, and to cover entrance orifice 62, for reasons which will be described hereinafter.

An insulation panel 91 is disposed between each adjacent pair of inner and outer side walls 14 and 17, and 16 and 19. Each insulation pane extends the entire distance from bottom 24 to top 20 and from front wall 12 to fireback 70. Panels 91 typically are formed of a high temperature fiberglass or a fibrous ceramic material such as FIBERFRAX, a trademark of the Carborundum Company, and each is about ½ inch to 1 inch thick.

Panels 91 assist to increase the temperature within combustion chamber 15, so that an adequate amount of charcoal is produced. This additional insulation prevents normal heat transfer through the side walls 14 and 16 which, at low burn rates, could lower combustion chamber temperatures below acceptable limits for charcoal production.

Secondary combustion package 40 will now be described with particular reference to FIGS. 2–6. Orifice 62 typically extends across the entire width of wall 42 of package 40, and is positioned immediately above grate 78. Preferably, the top edge of orifice 62 is disposed lower than the highest point on the front end 79 of grate 78 adjacent door 28. In this manner, charcoal 84, when deposited at the bottom of chamber 15 during burning of the fuel, slides down sloped grate 78 to accumulate around and to completely cover orifice 62. Thus, all exhaust gases exiting chamber 15 must pass through charcoal 84 before entering orifice 62.

Package 40 contains a plurality of substantially vertical baffles 64 which are aligned generally parallel to each other at a lower end. Baffles 64 typically are unitary with the material of package 40, although they need not be. Each of baffles 64 has an upper end 64 which is sloped or curved in a manner to cooperatively focus or concentrate all of the exhaust gases into a narrowed choke zone 68 near the center of package 40. Choke zone 68 is defined by inwardly projecting walls 66 within package 40. Baffles 64 promote mixing of the gases while not inhibiting movement thereof. Disposed above choke zone 68 is top wall 46 of package 40 which deflects the gases exiting choke zone 68 downwardly and out through openings 100 formed between downwardly extending walls 102 and wall 66. This abrupt change in direction further promotes mixing of the gases. Surrounding package 40 is a chamber defined by fireback 70 and wall 18 into which the gases exit through openings 100. This chamber communicates with flue opening 86 and allows the remaining gases to be vented through an exhaust pipe (not shown) in a conventional manner.

Disposed in wall 44 are a plurality of secondary air ports 90. Ports 90 communicate at one end with a plenum chamber 92 defined by projection 60, rear wall 18, wall 44 of package 40, and lateral walls 94. A single opening 96 is provided in wall 18 which allows secondary air to enter chamber 92 from the surrounding atmosphere. This secondary air is then equally distributed to each of ports 90 within chamber 92. Each port 90 extends through the material of base 48 and into the entrance orifice 62 with which it is in gaseous communication. Secondary air passing through ports 90 is immediately mixed with gases as they enter from chamber 15. Each port 90 is provided a downward slope, and is sufficiently long and narrow so that air passing through each port 90 is provided with a certain velocity. As a consequence, a jet of secondary air is emitted from the opening of each port 90 within orifice 62, further promoting mixing of the secondary air with the exhaust gases from chamber 15.

Any number of ports 90 may be provided, and the size of each port 90 can be adjusted, so long as the volume of air passing through ports 90 and into entrance orifice 62 is adequate to sustain secondary combustion. Similarly, any number of baffles 64 may be used in any arrangement, so long as they produce the desired mixing of secondary air with the exhaust gases. In a preferred embodiment, it has been found that by providing nine ports 90, and a corresponding number of baffles 64 and by aligning the space between each pair of adjacent baffles generally with a port 90, the desired result can be achieved. In this preferred embodiment, ports 90 are round and are approximately 5/16 inch in diameter. This embodiment produces the desired ratio of secondary air to combustion gases within entrance orifice 62 sufficient to sustain secondary combustion within package 40. Similarly, optimal mixing and secondary combustion have been achieved where the choke zone 68 has a width of about 4.5 inches, although other widths may be used so long as combustion is optimized in the secondary package.

All of walls 42, 44, 46, 48 and 50 and baffles 64 are formed of a high temperature, low density refractory material. One example of a suitable material is sold under the trademark PYROLITE by Rex Roto, Inc. Another example of a suitable material is sold under the trademark DURABOARD by Carborundum Company. These materials have a highly insulative quality which helps maintain the elevated secondary combustion temperatures required. Also, the walls and baffles reradiate heat generated by the secondary combustion back into the bases to assist in maintaining their temperatures at the required level.

In a preferred embodiment, secondary air opening 96 may be provided with means for adjusting the amount of secondary air entering opening 96, depending upon whether hard wood or soft wood is being burned. In a preferred embodiment, a wheel 106 is provided with a plurality of apertures, of various sizes, and is attached to rear wall 18 adjacent opening 96. Wheel 106 can be loosened and rotated, so that the desired aperature 107 can be placed in alignment with opening 96 to provide the desired metering of air into plenum chamber 92. Typically, for soft wood, a larger aperture 107 is used in wheel 106, while for hard wood, a smaller aperture 107 is used. Wheel 106 preferably is held in place by a screw 109 which is loosened for rotation of wheel 106, and which is tightened once the desired aperture 107 is placed in alignment with opening 96.

Figure 4:
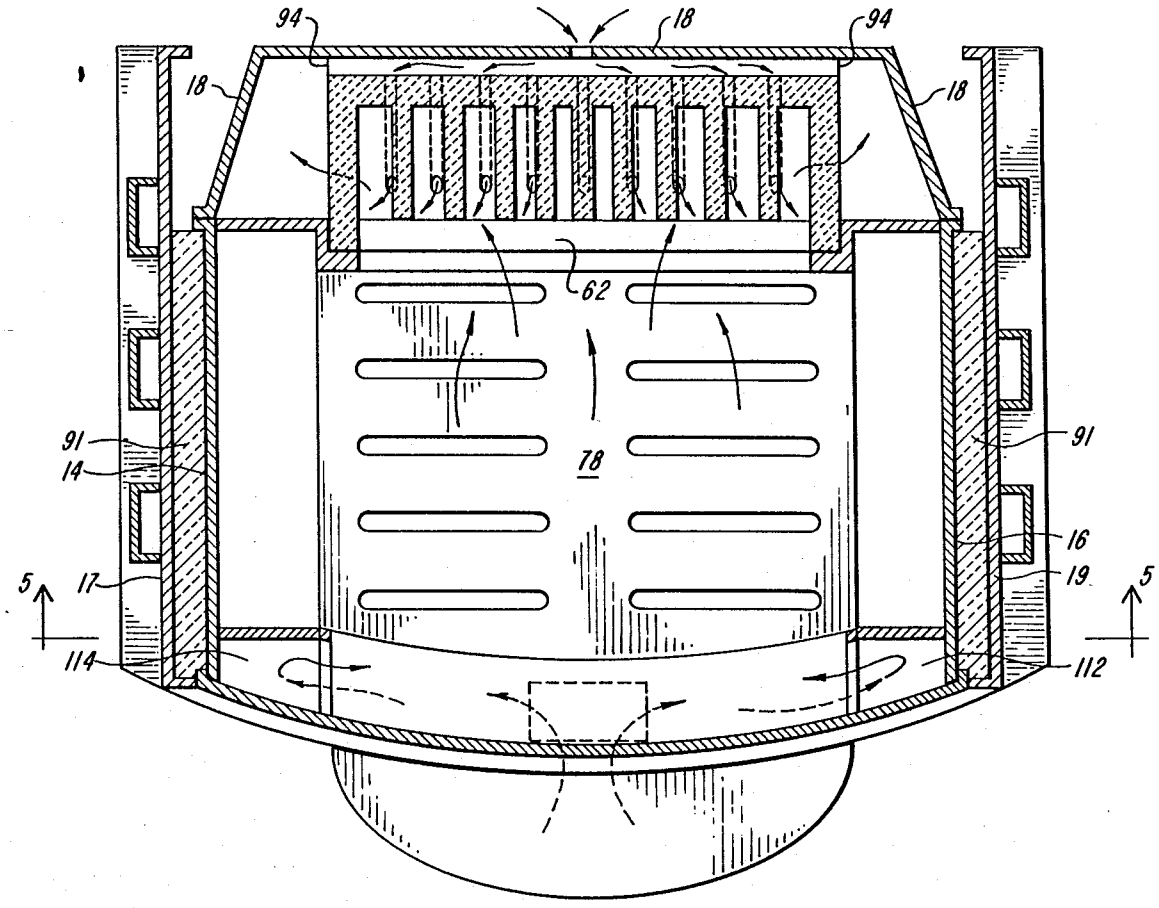
FIG. 4 is a cross sectional top view of the solid fuel stove of FIG. 1 taken along the line 4—4 of FIG. 1.
Figure 5:
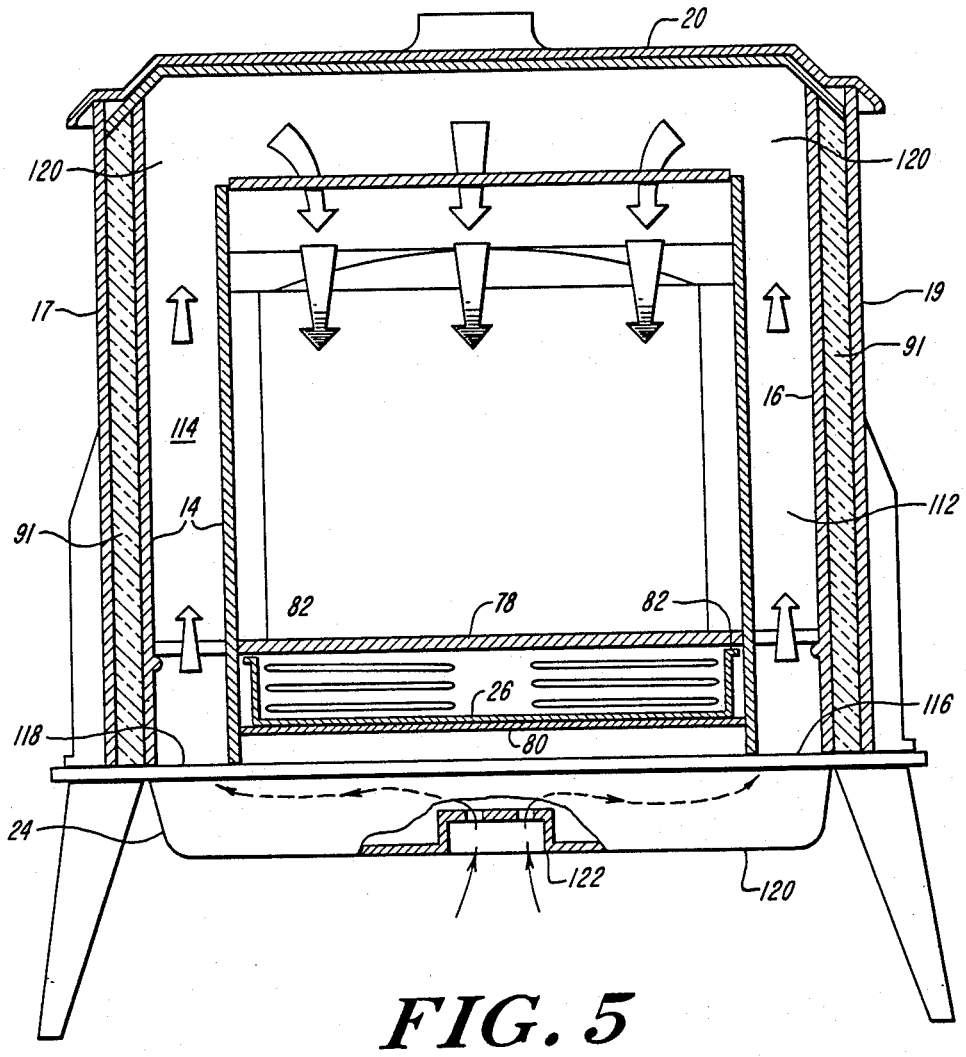
FIG. 5 is a cross sectional schematic front view of the solid fuel stove of FIG. 1 taken along the line 5—5 of FIG. 4.

The system for introducing primary air into chamber 15 is not essential for the proper operation of the secondary combustion package 40, and many different introduction systems may be used for the primary air. A preferred introduction system will now be described with reference in particular to FIGS. 2–6. In the preferred system, the primary air is directed downwardly over glass panel 36 to inhibit the deposition and condensation of soot and creosote, and to burn off soot and creosote already present. The primary air introduction system includes a series of manifolds which are internal to the stove, namely, manifolds 110, 112, 114, 116, 118 and 120. A primary air wash manifold 110 is positioned on the interior of front wall 12 above door 28 adjacent the top of glass panel 36. Side manifolds 112 and 114 are disposed on the interior of side walls 16 and 14, respectively. Bottom manifolds 116 and 118 are positioned along the bottoms of side manifolds 112 and 114, respectively. Bottom manifold 120 is positioned beneath plate 80 at the bottom of stove 10 adjacent the front wall 12 thereof. Bottom manifold 120 includes an opening 122 centrally disposed therein between manifolds 116 and 118. External air is received into manifold 120 through opening 122, and the air passing into manifold 120 is carefully controlled by adjustments to opening 122 to control the burn rate in chamber 15. External air then travels in both directions from opening 122 towards manifolds 116 and 118. This external air then travels through passages defined by manifolds 112 and 114 upwardly into manifold 110. As this outside air passes through manifold 116 and 118 and upwardly through manifolds 112 and 114, it is heated by the fire in the primary combustion chamber 15 and by the hot walls of side manifolds 112 and 114. Side manifolds 112 and 114 contain conduits 120 at the top left and top right corners, respectively, as shown in FIG. 4 of the stove for symmetrically delivering air into opposite ends of primary air wash manifold 110. Turbulence is largely removed from the air in a large expansion region 122 of manifold 110, and this air is then delivered via aperture 126 through an elongated exit slot 124 in a uniform sheet or curtain, downwardly over the interior of glass panel 36. Exit slot 124 extends across the top of glass panel 36, and should have a relatively uniform width to insure uniform air flow across panel 36.

Expansion region 122 and aperture 126 are defined by primary air wash manifold 110, in combination with front wall 12. Aperture 126 restricts air flow from expansion region 122 to exit slot 124. Manifold 110 extends with substantially symmetrical and ideally uniform cross section across the top of front wall 12. Manifold 110 can also be mounted on door 28 above glass panel 36, if desired. Manifold 110 has a relatively large volume, for example, 150 cubic inches, and creates a reservoir of low turbulence air which helps to insure the uniformity of the curtain of air delivered downwardly across glass panels 36. Preferably, the ratio of the volume enclosed by manifold 110 to the surface area of glass panel 36 is in the range of between about 0.5 inches$^3$/ inches$^2$, and about 0.25 inches$^3$/inches$^2$.

Side manifolds 112 and 114, in combination with side walls 16 and 14, define enclosed volumes through which air passes and is heated. Side manifolds 112 and 114 are relatively thin and have a large area directly exposed to the heat of the primary fire in chamber 15 where fuel is burned. The symmetrical hot air flow to manifold 110 can be achieved by introducing the hot air into manifold 110 through any number of orifices, so long as the orifices are positioned in a generally symmetrical manner with respect to manifold 110. It has been found that symmetrical delivery of air into manifold 110 is critical in achieving a uniform curtain of air across glass panels 36 in all operating conditions from very low fire to very high fire conditions.

The operation of the stove 10 of the present invention will now be described with reference to the figures. Initially, an adequate amount of kindling is placed on grate 78, and the solid fuel is placed on top of the kindling in a conventional manner. Typically, wood is used in stove 10 of this invention, but coal may also be used. The kindling can be any conventionally used material for such stoves. The damper is unlatched so that chamber 15 communicates directly with flue opening 86. The kindling and fuel may be loaded either through door 28, or griddle 22. Typically, the kindling is ignited by opening door 28. Once door 28 is closed, the fuel and kindling will begin to ignite in a conventional manner. The primary air enters opening 122, passes through manifold 120 up side manifolds 112 and 114 and is introduced into combustion chamber 15 through manifold 110. By this time, the primary air has been somewhat preheated, helping to maintain the required combustion temperatures within chamber 15. Once a bed of charcoal begins to form, damper 72 is closed and latched. Thereafter, all exhaust gases must exit through secondary combustion package 40, and these gases will pass through charcoal 84 prior to entering entrance orifice 62 of package 40. As these gases pass through charcoal 84, they are preheated by direct contact with the charcoal, and by interaction of oxygen in the exhaust gases with the charcoal. Furthermore, because of the provision of insulation panels 91, the temperature within chamber 15 rapidly rises to a level sufficient to create and maintain charcoal 84. This additional heat retention further preheats the gases prior to entering charcoal 84, and further promotes the formation of charcoal 84. The more the gases are preheated prior to entering charcoal 84, the less they must be heated by charcoal 84.

As these exhaust gases enter orifice 62, secondary air is injected into them through ports 90. This secondary air has been drawn in from the external atmosphere through opening 96 in wall 18 and into chamber 92. In chamber 92, this secondary air is uniformly distributed to each of ports 90, from whence it passes into orifice 62. Since each port 90 contains a generally equal volume of air, substantially uniform mixing of secondary air with the exhaust gases occurs in orifice 62. Furthermore, because of the configuration of ports 90, as previously described, the secondary air enters orifice 62 in the form of jets which further promotes the mixing. These jets are thus mixed with the exhaust gases just after leaving charcoal 84 when the exhaust gases are at their maximum temperature. As a consequence, the secondary combustion is relatively easy to initiate, and to sustain during changes in the exhaust gas composition. The secondary air and exhaust gas mixture then passes upwardly into package 40 past baffles 64. Because of the curved, focussing nature of baffles 64, further mixing occurs and further secondary combustion occurs in transit through the baffles. The surfaces of the baffles reradiate heat, maintaining the temperatures within the secondary combustion chamber to further sustain secondary combustion. The gases then pass through choke zone 68, impinge against wall 46 and pass outwardly through openings 100. This abrupt change in direction of the gases further promotes mixing and secondary combustion. After having passed through opening 100, the gases pass through opening 86 and are vented through an exhaust pipe.

The foregoing described features of this invention provide for superior combustion of particulates, creosote, and volatiles for a number of reasons. Placement of orifice 62 at a low position in the fire box adjacent grate 78, and the sloping of grate 78 to promote the accumulation of charcoal 84 adjacent orifice 62, which is a natural collection area for the charcoal formed during the combustion process, forces the gases and particulates exiting chamber 15 to pass through a bed of charcoal. This causes unburned oxygen remaining in the exiting gases to react with the charcoal bed, raising the temperature of the gases, or preheating the gases to a temperature where, after these gases are mixed with secondary air, they will readily combust in the secondary package. This feature allows relatively complete combustion of particulates, creosote, and volatiles, even during a low burn rate operation. The process is self sustaining at any burn rate, as long as an adequate charcoal bed is established during the kindling phase, or prior to adding the first main load, and subsequent fuel loads are added while adequate charcoal remains in the exit orifice.

The provision of insulation panels 91 along the sides of primary fire box helps increase and maintain the temperature within the fire box. This maintenance of the temperature is important in the production of adequate amounts of charcoal so that the exit orifice 62 is kept full. The increase or maintenance of the combustion chamber temperature also assists in the preheating of the combustion gases prior to their entry into orifice 62. As a result, the overall system is less sensitive to small changes and other parameters required to obtain and sustain secondary combustion.

Baffles 64 are positioned to reduce flow restrictions, but the focussing configuration thereof causes significant mixing between the combustion gases, including the particulate matter and creosote, and secondary air. Baffles 64, and other surfaces surrounding them, because they are formed of highly insulative material, hold the heat, and provide surfaces which reradiate heat into the gas mixture to help sustain elevated secondary combustion temperatures. Choke zone 68 focuses the secondary combustion through a single orifice, again promoting additional mixing and concentration of the heat to maintain the combustion temperature within package 40. The abrupt change in direction of the gases as they leave zone 68 again promotes the desired mixing. The inner surface of wall 46, and walls 66 and 102, also reradiate heat to help maintain the highest possible temperatures, because of the highly insulative quality of the material which forms these walls.

Because ports 90 are uniformly distributed across the width of orifice 62, and because ports 90 are of uniform diameter, a fixed amount of secondary air is metered into the secondary package orifice 62. Because of this metering and uniform distribution of secondary air, and because the secondary air is introduced in jets at orifices 62, the maximum mixing occurs in the desired ratios with the combustion gases at the point where those gases are at their maximum temperature after having just passed through the charcoal bed. Because the mixing occurs at the highest temperatures achieved by the combustion gases, particulate matter and creosote, maximum secondary combustion thereof is produced.

The foregoing described stove has a high thermal efficiency in combination with the ability to remove substantial amounts of particulate material, unburned volatiles and creosote. The resulting atmospheric emissions satisfy most existing government regulations with respect to particulate and gaseous emissions. The secondary combustion is sustained, even during and after shifts in the fuel load, and a high level of performance in the secondary combustion package is maintained even over a range of burn rates from very low to very high. No catalytic combustor is required. The secondary combustion package will not cool sufficiently to prevent reignition, even if the exhaust gas composition is changed over a short period. This is because the heat is maintained in the system, so long as the charcoal level is maintained. As can be seen, problems inherent in prior art secondary combustion chambers have been overcome, even without the need of a catalytic combustor.

Although stove 10 is formed entirely of cast iron, except for secondary combustion package 40, insulating panels 91, and glass panel 36, the design is not known to be dependent upon the materials used, and stove 10 may be formed of other suitable materials which are not combustible.

In view of the above description, it is likely that modifications and improvements may occur to those skilled in the art within the scope of this invention. Thus, the above description is intended to be exemplary only, the scope of the invention being described in the following claims and their equivalents.

What is claimed is:

1. A heating apparatus for burning solid fuels comprising:

a frame assembly enclosing a primary combustion chamber for burning a supply of solid fuel contained therein, said frame assembly including a front wall, two side walls, a rear wall, a top and a bottom;

a grate for carrying a supply of solid fuel contained within said primary combustion chamber, said grate being disposed at an acute angle with respect to a selected one of said front, side and rear walls for promoting the accumulation of charcoal formed from combustion of the solid fuel against said selected one of said walls at a bottom end thereof; and a secondary combustion chamber in gaseous communication with said primary combustion chamber for removal of pollutants from exhaust gases exiting said primary combustion chamber, said secondary combustion chamber comprising:

an entrance orifice disposed in said selected one of said walls at a bottom end thereof closely adjacent said grate, whereby said entrance orifice may be covered by charcoal during operation of said apparatus whereby exhaust gases exiting said primary combustion chamber into said secondary combustion chamber pass through charcoal;

means for metering secondary combustion air containing oxygen into said entrance orifice for mixing with exhaust gases exiting from said primary combustion chamber;

baffles arranged to enhance mixing of said combustion gases with secondary air to promote the more complete burning of pollutants, each of said baffles comprising a generally vertically oriented lower portion and an upper portion, said lower portions of said baffles being generally parallel to one another and said upper portions of said baffles having surfaces which are non-parallel and converging with respect to one another for causing convergence of exhaust gases and secondary combustion air; and means for venting the exhaust gases from said secondary combustion chamber to an exhaust pipe.

2. The heating apparatus of claim 1 wherein said metering means includes means for evenly distributing secondary combustion air over the width of said entrance orifice.

3. The heating apparatus of claim 2 wherein said metering means comprises:

a plurality of ports evenly distributed across the entrance orifice, each of said ports having a predetermined diameter and a first end and a second end in communication with said entrance orifice;

a plenum chamber in gaseous communication with a first end of said ports for evenly distributing secondary air to each of said ports; and an opening in said plenum chamber communicating with an ambient atmosphere external of said apparatus for metering secondary combustion air into said plenum chamber.

4. The heating apparatus of claim 3 further comprising means for varying the size of said opening in said plenum chamber.

5. The heating apparatus of claim 1 further comprising means for permitting loading of said primary combustion chamber with solid fuel from said top of said frame assembly.

6. The heating apparatus of claim 1 further comprising a door mounted on one of said front, side and rear walls of said frame assembly to permit access to said primary combustion chamber.

7. The heating apparatus of claim 1 wherein said secondary combustion chamber further comprises means for providing a narrowed choke zone through which exhaust gases and the secondary combustion air pass after leaving said baffles but prior to entering an exhaust pipe to promote further mixing of the gases.

8. The apparatus of claim 7 wherein said secondary combustion chamber further comprises means for rapidly reversing the direction of flow of the exhaust gases and secondary combustion air after leaving said choke zone but prior to entering an exhaust pipe.

9. The heating apparatus of claim 1 further comprising mans for insulating both of said side walls of said frame assembly.

10. The heating apparatus of claim 1 wherein said secondary combustion chamber is formed of a highly insulating refractory material for reradiating heat into a mixture of exhaust gases and secondary combustion air contained therein.

11. The heating apparatus of claim 1 further comprising operable damper means for allowing gaseous communication between said primary combustion chamber and said venting means for allowing exhaust gases to bypass said secondary combustion chamber during start-up.

12. The heating apparatus of claim 1 further comprising:

a transparent glass panel mounted in one of said frame assembly walls to permit viewing of combustion in the primary combustion chamber; and glass panel cleaning means for supplying a curtain of hot air flowing uniformly downwardly over the interior surface of said transparent glass panel for maintaining said panel at an elevated interior temperature and for forming a barrier to prevent soot and creosote from building thereon, said glass panel cleaning means including:

a first manifold for providing a reservoir of low turbulence air, said manifold being positioned above said glass panel and having an aperture for directing hot air downwardly; and means for supplying hot air to said first manifold.

13. The heating apparatus of claim 12 wherein said means for supplying hot air to said first manifold comprises side manifolds positioned on the interior of each of said frame assembly side walls for heating of the air therein, said side manifolds being connected for symmetrical hot air flow to said first manifold.

14. The heating apparatus of claim 13 further comprising means for introducing air into said side manifolds from the bottom of said frame assembly.

15. The heating apparatus of claim 1 further comprising an ash pan disposed below said grate, said ash pan being disposed at generally the same angle with respect to said selected one of said walls as said grate, said ash pan being adapted for the collection of ash from said grate.

16. A heating apparatus for burning wood fuel comprising:

a frame assembly enclosing a primary combustion chamber for burning of a supply of wood contained therein, said frame assembly including a front wall, two side walls, a rear wall, a top and a bottom;

a secondary combustion chamber disposed within said frame assembly adjacent a selected one of said front wall, said side walls, and said rear wall, said secondary combustion chamber having a bottom end disposed adjacent said bottom of said frame assembly;

a sloped grate for carrying a supply a wood contained within said primary combustion chamber, said grate being disposed at an acute angle with respect to said selected one of said walls for promoting the accumulation of charcoal formed from combustion of wood against said selected one of said walls at said bottom end of said secondary combustion chamber;

an entrance orifice disposed in said selected one of said walls for providing gaseous communication between said primary combustion chamber and an interior of said secondary combustion chamber, said entrance orifice being disposed on said bottom end of said secondary combustion chamber closely adjacent said grate, whereby said entrance orifice may be covered by charcoal formed by combustion during operation of said apparatus whereby exhaust gases exiting said primary combustion chamber into said secondary combustion chamber pass through charcoal;

means for metering secondary air containing oxygen into said entrance orifice for uniform mixing of secondary air with exhaust gases drawn into said entrance orifice from said primary combustion chamber;

refractory baffles disposed within said secondary combustion chamber for promoting mixing of said combustion gases, each of said baffles comprising:

a lower portion, said lower portions of said baffles being generally parallel to one another and generally aligned in a vertical direction; and an upper portion, said upper portions of said baffles having non-parallel, converging surfaces for focussing gases passes therethrough into a narrowed choke zone; and means for conducting gases exiting from said secondary combustion chamber to an exhaust pipe.

17. The heating apparatus as recited in claim 16 wherein said metering means introduces secondary air into said entrance orifice through a plurality of ports.

18. The heating apparatus as recited in claim 16 further comprising means for insulating said side walls of said frame assembly.

19. The heating apparatus of claim16 wherein said secondary combustion chamber further comprises means for providing said narrowed choke zone through which exhaust gases and the secondary combustion air pass after leaving said baffles but prior to entering an exhaust pipe to promote further mixing of the gases.

20. The apparatus of claim 19 wherein said secondary combustion chamber further comprises means for rapidly reversing the direction of flow of the exhaust gases and secondary combustion air after leaving said choke zone but prior to entering an exhaust pipe.

21. A heating apparatus for burning solid fuels comprising:

a frame assembly enclosing a primary combustion chamber for burning a supply of solid fuel contained therein, said frame assembly including a front wall, two side walls, a rear wall, a top and a bottom;

a grate for carrying a supply of solid fuel contained within said primary combustion chamber, said grate being disposed at an acute angle with respect to a selected one of said front, side and rear walls for promoting the accumulation of charcoal formed from combustion of the solid fuel against said selected one of said walls at a bottom end thereof;

a secondary combustion chamber in gaseous communication with said primary combustion chamber for removal of pollutants from exhaust gases exiting said primary combustion chamber, said secondary combustion chamber comprising:

an entrance orifice disposed in said selected one of said walls at a bottom end thereof closely adjacent said grate, whereby said entrance orifice may be covered by charcoal during operation of said apparatus;

means for metering secondary combustion air containing oxygen into said entrance orifice for mixing with exhaust gases exiting from said primary combustion chamber;

baffles arranged to enhance mixing of said combustion gases with secondary air to promote the more complete burning of pollutants, each of said baffles comprising a generally vertically oriented lower portion and an upper position, said lower portions of said baffles being generally parallel to one another, and said upper portions of said baffles having surfaces which are non-parallel and converging with respect to one another for causing convergence of exhaust gases and secondary combustion air; and means for venting the exhaust gases from said secondary combustion chamber to an exhaust pipe.

* * * * *